US006729499B2

(12) United States Patent
Vidondo

(10) Patent No.: US 6,729,499 B2
(45) Date of Patent: May 4, 2004

(54) SYSTEM FOR CONVEYING A SELECTED PRODUCT TO A COLLECTION COMPARTMENT IN AUTOMATIC VENDING MACHINES

(75) Inventor: Félix Guindulain Vidondo, Peralta (ES)

(73) Assignee: Jofemar, S.A., Peralta (ES)

( * ) Notice: Subject to any disclaimer, the term of this patent is extended or adjusted under 35 U.S.C. 154(b) by 43 days.

(21) Appl. No.: 10/135,977

(22) Filed: Apr. 30, 2002

(65) Prior Publication Data

US 2002/0162851 A1 Nov. 7, 2002

(30) Foreign Application Priority Data

May 7, 2001 (ES) ..... 200101043

(51) Int. Cl.[7] ..... G07F 9/00

(52) U.S. Cl. ..... 221/192; 221/123; 221/124; 221/130; 221/131

(58) Field of Search ..... 221/123, 124, 221/129, 130, 137, 133, 192, 224, 236, 290

(56) References Cited

U.S. PATENT DOCUMENTS

| | | | | |
|---|---|---|---|---|
| 2,358,563 A | | 9/1944 | Donaldson | |
| 3,252,617 A | * | 5/1966 | Ficken | 221/116 |

FOREIGN PATENT DOCUMENTS

| | | | | |
|---|---|---|---|---|
| CH | 585 444 A | | 2/1997 | |
| DE | 44 46 565 C | | 7/1996 | |
| DE | 196 04 561 A | | 8/1997 | |
| FR | 2 629 700 A | | 10/1989 | |
| GB | 2 275 678 A | | 9/1994 | |
| JP | 01250192 A | * | 10/1989 | G07F/11/00 |
| JP | 02061790 A | * | 3/1990 | G07F/11/58 |
| JP | 02129787 A | * | 5/1990 | G07F/9/00 |
| JP | 02129788 A | * | 5/1990 | G07F/9/00 |
| JP | 03240191 A | * | 10/1991 | G07F/11/58 |
| JP | 04033091 A | * | 2/1992 | G07F/11/00 |
| JP | 04077893 A | * | 3/1992 | G07F/11/58 |

* cited by examiner

*Primary Examiner*—Donald P. Walsh
*Assistant Examiner*—Kaitlin Joerger
(74) *Attorney, Agent, or Firm*—Klauber & Jackson

(57) ABSTRACT

The system for conveying a selected product to a collection compartment in automatic vending machines is especially suitable for automatic tobacco vending machines, in which a unitary extraction from a storage unit is carried out once a product has been selected so as to deliver the product to the collection compartment. The system comprises a pair of elastic conveyor belts (4, 5) guided by certain cylindrical bodies (6), which can be aided by some freely rotating rods (7), with one of the cylindrical bodies (6) acting on each one of the elastic belts as a drive element for transmitting independent movement to them. A first elastic belt (4) is fitted in order to define an initial horizontal section (8) under the storage units (2) with a second section (9) in a vertical position on one side of the machine, while the second conveyor belt (5) is fitted in a position backing onto the vertical section (9) of the first belt (4).

4 Claims, 4 Drawing Sheets

SYSTEM FOR CONVEYING A SELECTED PRODUCT TO A COLLECTION COMPARTMENT IN AUTOMATIC VENDING MACHINES

OBJECT OF THE INVENTION

As stated in the heading of this description, this invention consists of a system for conveying a selected product to a collection compartment in automatic vending machines, being of particular utility in automatic vending machines for tobacco, in such a way that the conveyance system consists of a pair of conveyor belts, duly guided, which, as they are displaced, convey the selected product dispensed from the corresponding storage unit in which they are stacked, until meeting up with the diverter element which diverts them to the duct leading to the collection compartment.

The system that is described permits the storage capacity of the machine to be exploited to the maximum since the products are dispensed towards a first elastic conveyor belt fitted in such a way that it presents a first section that is horizontal in relation to the lower part of the machine, and a second section that is vertical, which is connected to the second elastic conveyor belt, conveying the product trapped between them and raising it laterally until it runs up against the diverter element.

In this way, product storage units can be fitted with a greater height, in other words, with greater capacity, or a larger number of storage units can be fitted, since they will be able to be arranged in accordance with storage units accounting for half the height, with which the variety of products will be able to be increased.

Moreover, given that the product is raised up trapped between two elastic conveyor belts until being diverted towards the duct leading to the collection compartment, this compartment can be located at the desired height, thus facilitating the collection of the product by the user.

Furthermore, the collection compartment will be able to have small dimensions since, in the case of automatic vending machines for tobacco, the packets of tobacco are always directed towards the compartment in the vertical position.

TECHNICAL FIELD OF THE INVENTION

The system for conveying a selected product to a collection compartment in automatic vending machines is of special application in automatic vending machines for tobacco, which are actuated by means of introducing coins.

BACKGROUND OF THE INVENTION

Conventionally, automatic tobacco vending machines incorporate a series of storage units, known as grills, in which the products are stacked. At the bottom of each of the individual storage units for the products is the corresponding unitary extractor for the products, in such a way that at the moment of making the selection of a product, following the introduction of the precise amount of money, the unitary extractor causing the dispensing is activated.

Thus, conventionally, the machines may have two grills, with the corresponding storage units, according to a single height, or they can present four grills with the corresponding individual storage units, according to two heights, with the products dispensed in relation to the upper grills being led via the corresponding duct in order to avoid possible jamming.

In this way, the product dispensed in relation to the lower storage grills falls by simple gravity directly to the collection compartment for the product, to which those grills converge at the bottom, while in the case of the machine having four storage grills, according to two heights, the products dispensed in relation to the upper storage grills must be led via simple metal sheet pieces provided for that purpose so that they can be directed towards the collection compartment.

With this design of vending machine, the different storage units for the products stacked in them need to have the corresponding unitary extractors fitted underneath them. But, moreover, the right space needs to be left free for leading the dispensed products towards the collection compartment, bearing in mind furthermore that the collection compartment for the products should not be too low down.

As a result of all this, and taking into account that the capacity of the vending machines should be optimised as much as possible, the collection compartment for the products is placed in a position that is relatively low, which compels users to bend down in order to collect them, which is uncomfortable for certain users.

Thus, vending machines may on occasions have a utility cabinet underneath as a store in order to make use of that space, as well as permitting the machine, and more specifically the product collection compartment, be placed at a suitable height, all of which has an impact on the actual capacity of the machine.

DESCRIPTION OF THE INVENTION

This report describes a conveyance system to the collection compartment for the product selected in automatic vending machines, being of particular utility in automatic vending machines for tobacco, in which, once a product has been selected, its unitary extraction from a storage unit is proceeded with and it is led to the compartment for collection by the user, in such a way that the conveyance system for the products consists of a pair of elastic conveyor belts guides by certain cylindrical bodies, which can be aided by some freely rotating rods, with one of the cylindrical bodies acting on each one of the elastic belts as a drive element for transmitting independent movement to them, in such a way that a first elastic belt is fitted in order to define an initial horizontal section under the storage units for the products with a second section in a vertical position on one side of the machine, while the second conveyor belt is fitted in a position backing onto the side vertical section of the first belt, presenting between the vertical section of the first elastic conveyor belt and the second elastic conveyor belt backed onto it a diverter element, arranged in an inclined position, which diverts the product towards the duct that leads to the collection compartment.

The product selected and dispensed by the corresponding unitary extractor falls freely onto the horizontal section of the first elastic conveyor belt, and is conveyed by it until it reaches the vertical section, in relation to which it is conveyed and raised by becoming trapped between the backing elastic conveyor belts until it runs up against the diverter element, which diverts it towards the duct that leads to the collection compartment.

Moreover, the second elastic conveyor belt, backed onto the side vertical section of the first elastic conveyor belt, presents in its lower part a small horizontal section backed onto the horizontal section of the first elastic conveyor belt, facilitating the trapping of the product between both elastic conveyor belts.

The collection compartment for the product is positioned on one side of the machine at the desired height, being arranged in the vertical direction and facilitating collection by the user since it is placed at an ergonomic height.

In this way, the capacity of the machine is increased by permitting a greater height for the storage units containing the stacked products when the machine has two grills, within any need to increase the height of the machine, with the great advantage that this represents, or, as well as increasing the capacity of the machine, it also permits the variety of products dispensed to be increased when the machine presents four grills, according to two heights.

In addition, the fact that the collection compartment for the selected product can be placed at the desired height, thus facilitating collection by the user, contributes a great advantage.

In order to complement the description that is going to be made below, and with the aim of aiding a better understanding of the characteristics of the invention, this descriptive report is accompanied by a set of drawings whose figures represent the most characteristic details of the invention, in a way to be regarded as illustrative rather than limiting.

DESCRIPTION OF A PREFERRED EMBODIMENT OF THE INVENTION

Figure 1:
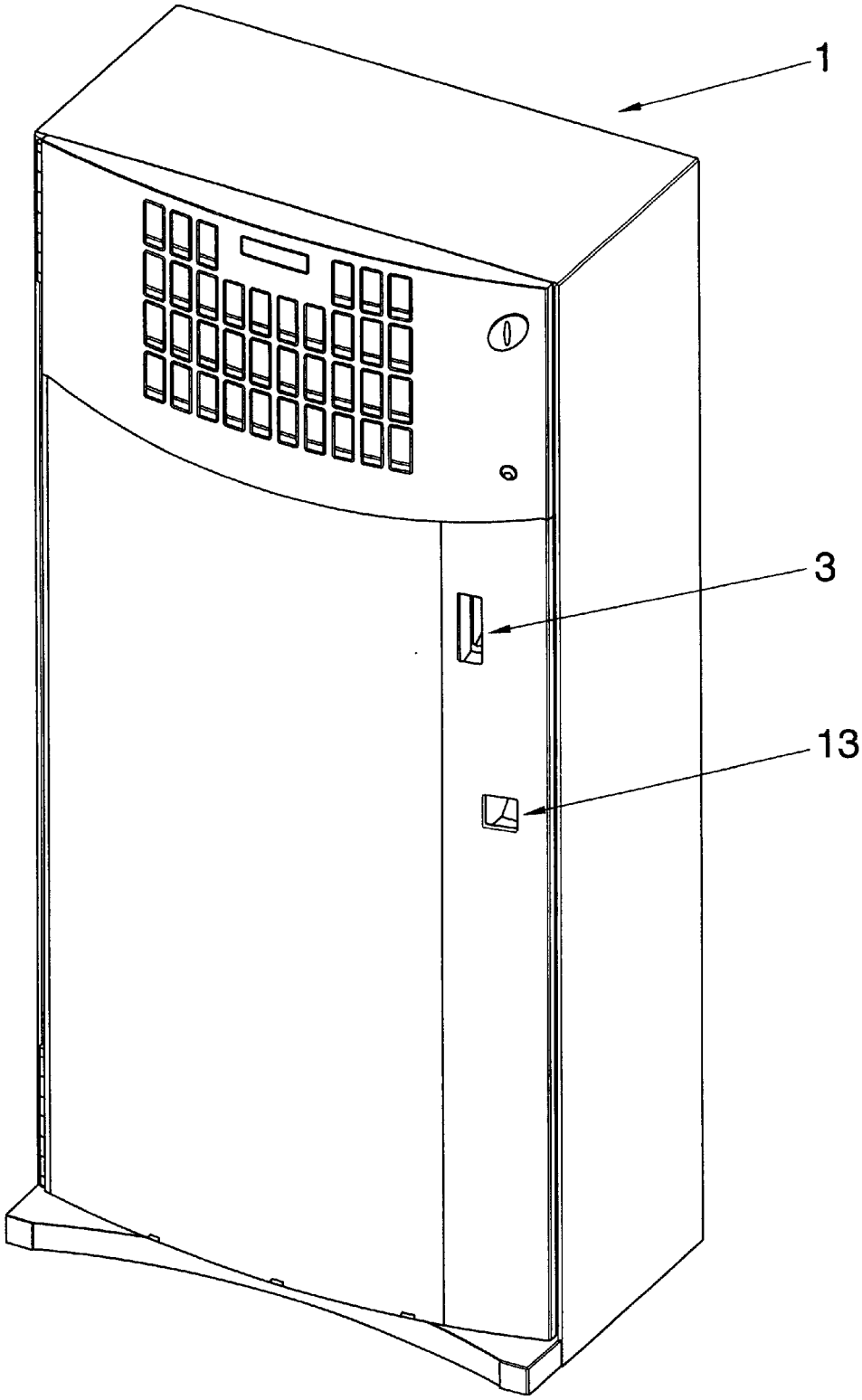
FIG. 1 shows a perspective view of an automatic vending machine in which it can be seen how the collection compartment for the selected product can be found on one of the sides, being arranged in the vertical position and at a certain height.

From the figures, and in accordance with the numbering adopted, it may be observed how the automatic vending machine 1 for products has a series of storage units 2 for the products stacked in them, with the respective unitary extractor for the product being located underneath the corresponding storage units 2, in such a way that once the value of the product that is desired has been introduced, the extraction of the product is proceeded with in order to be led to the compartment for collection by the user.

Thus, the automatic machine 1 incorporates a system for conveying the selected product to the compartment 3 for collection by the user, with this system consisting of a pair of elastic conveyor belts 4 and 5 guided by certain cylindrical bodies 6, which might be aided by some freely rotating rods 7, one of the cylindrical guiding bodies 6, relative to one of the elastic belts 4 and 5, acting as a drive element in order to transmit movement to them, in such a way that the first elastic conveyor belt 4 is fitted in order to define a first horizontal section 8 under the different storage units 2 for the products, and a second section 9 being in a vertical position along one side of the machine.

In other words, each of the elastic belts 4 and 5 is independently guided by one of the bodies 6 by which they are guided, with the respective drive means transmitting movement to the corresponding body 6 as if it were a simple motor.

Moreover, the second elastic conveyor belt 5 is fitted in a backed position, in relation to one of its faces, to the vertical side section 9 of the first elastic conveyor belt 4, and between the vertical section 9 of the first elastic belt 4 and the second elastic belt 5 backed onto it is a diverter element 10 that diverts the product 11 towards the duct 12 which leads to the collection compartment 3, the diverter element 10 being arranged in an inclined position and in relation to its upper part.

The product 11, selected and dispensed by the corresponding unitary extractor, falls onto the horizontal section 8 of the first elastic conveyor belt 4, either by simple gravity or directed when the machine has four grills, according to two heights, being conveyed by the said elastic belt 4 until reaching its vertical section 9, in relation to which it is conveyed and raised in collaboration with the elastic belt 5 by becoming trapped between one of the backed faces of each elastic conveyor belt 4 and 5 until it runs up against the diverter element 10.

In this way, the elasticity of both conveyor belts means that the product can be trapped between the backed face of both, conveying it and raising it laterally, as far as the desired point where it runs up against the diverter element 10, which diverts it to the duct 12 as far as the collection compartment 3, with this compartment being able to be positioned at the desired height in order to facilitate collection of the product.

So, the horizontal section 8, relative to the first conveyor elastic belt 4, becomes positioned in relation to the lower part of the casing of the automatic machine, with the different products dispensed falling on it, which permits the storage units 2 for the products stacked in them to be able to have a greater height, which in turn increases the storage capacity of the machine, with the great advantage that this represents.

Figure 2:
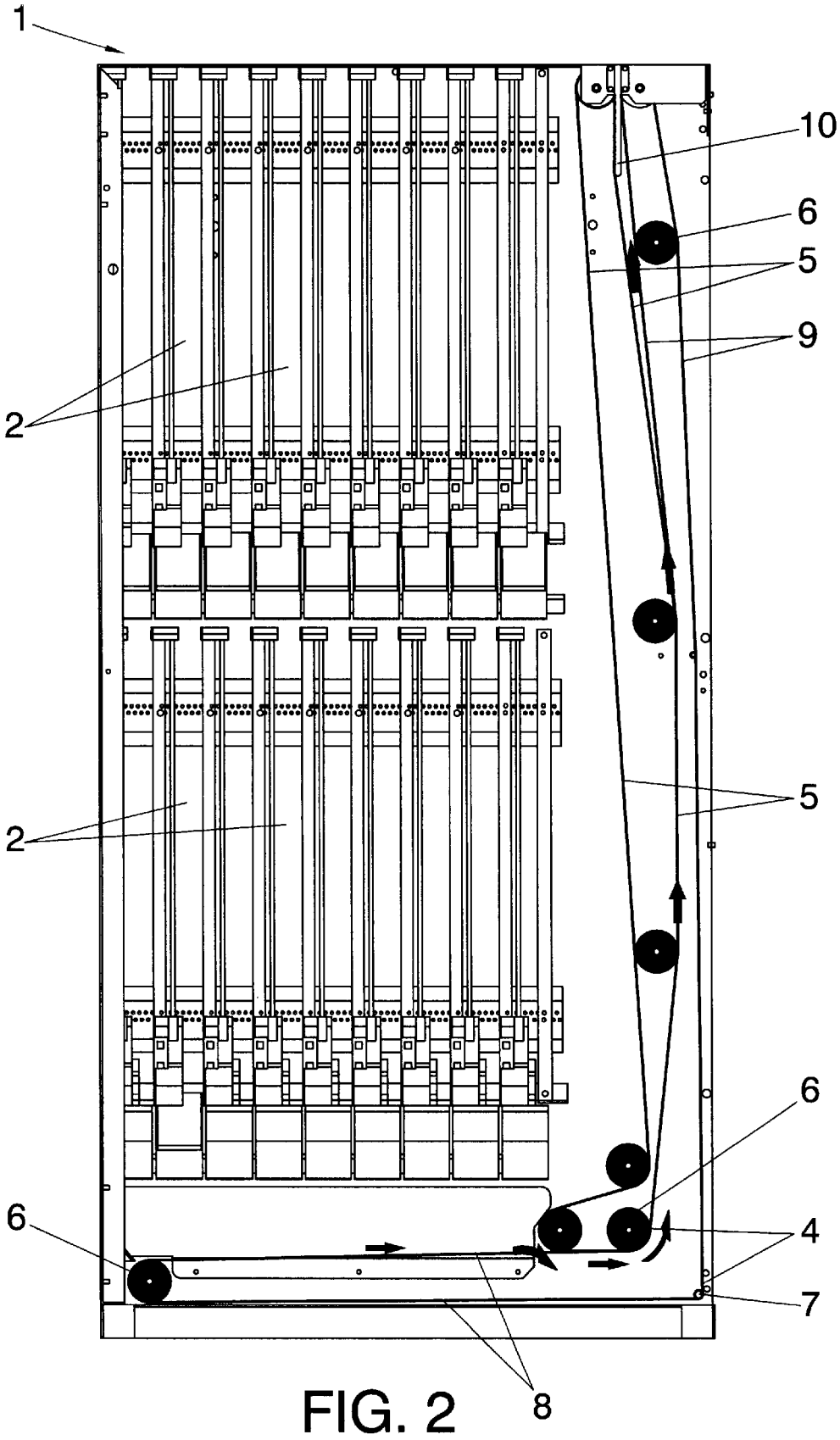
FIG. 2 shows a front view of the conveyance system for the selected product in automatic vending machines, in which it can be seen how this system is defined by a pair of elastic conveyor belts duly guided, and a diverter element for the product towards the duct that leads to the collection compartment, with this design presenting four grills, according to two heights.
Figure 3:
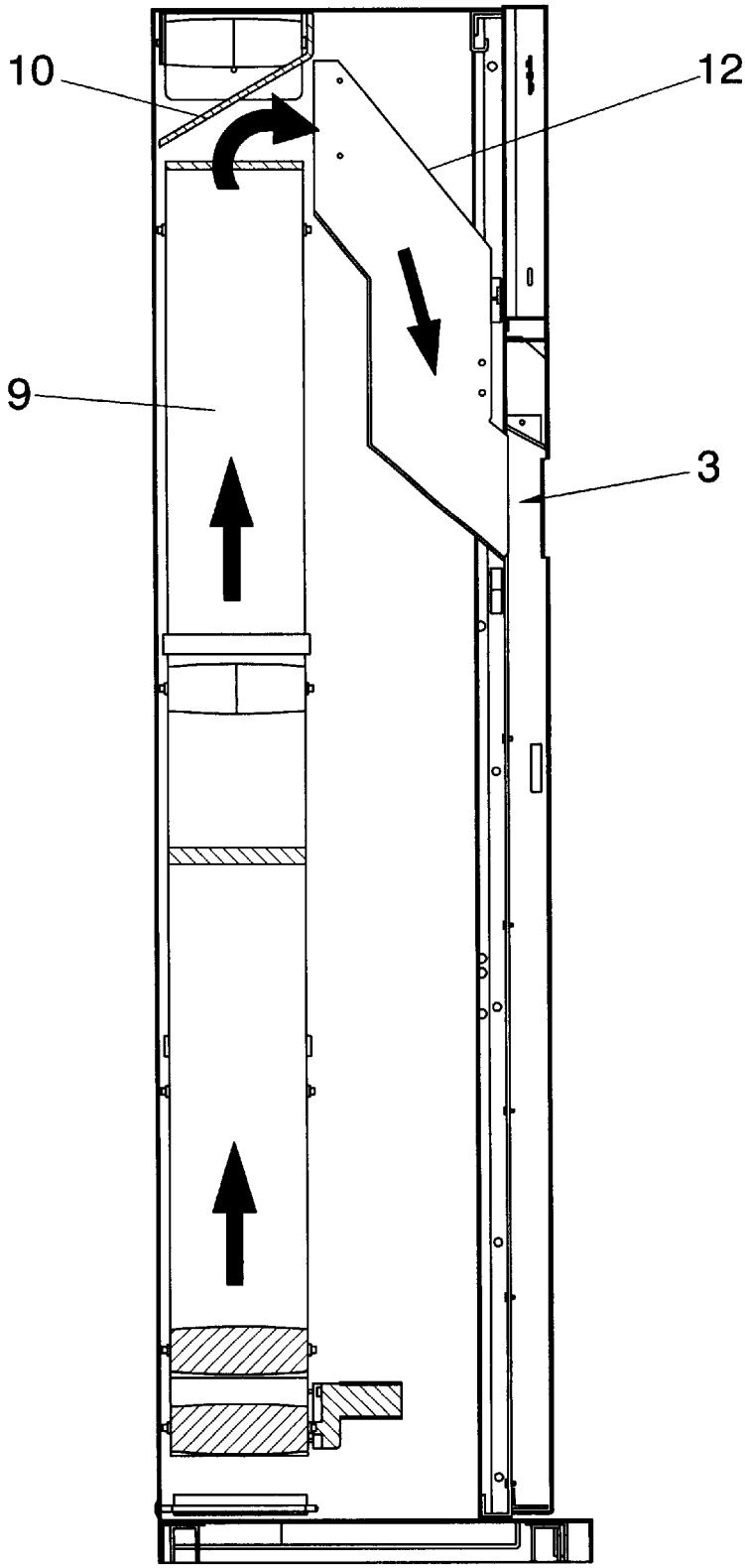
FIG. 3 shows a side elevation view of the conveyance system for the selected product in automatic vending machines, in which can be seen the diverter element for the product towards the collection compartment, with the diverter element being fitted in an inclined position.
Figure 4:
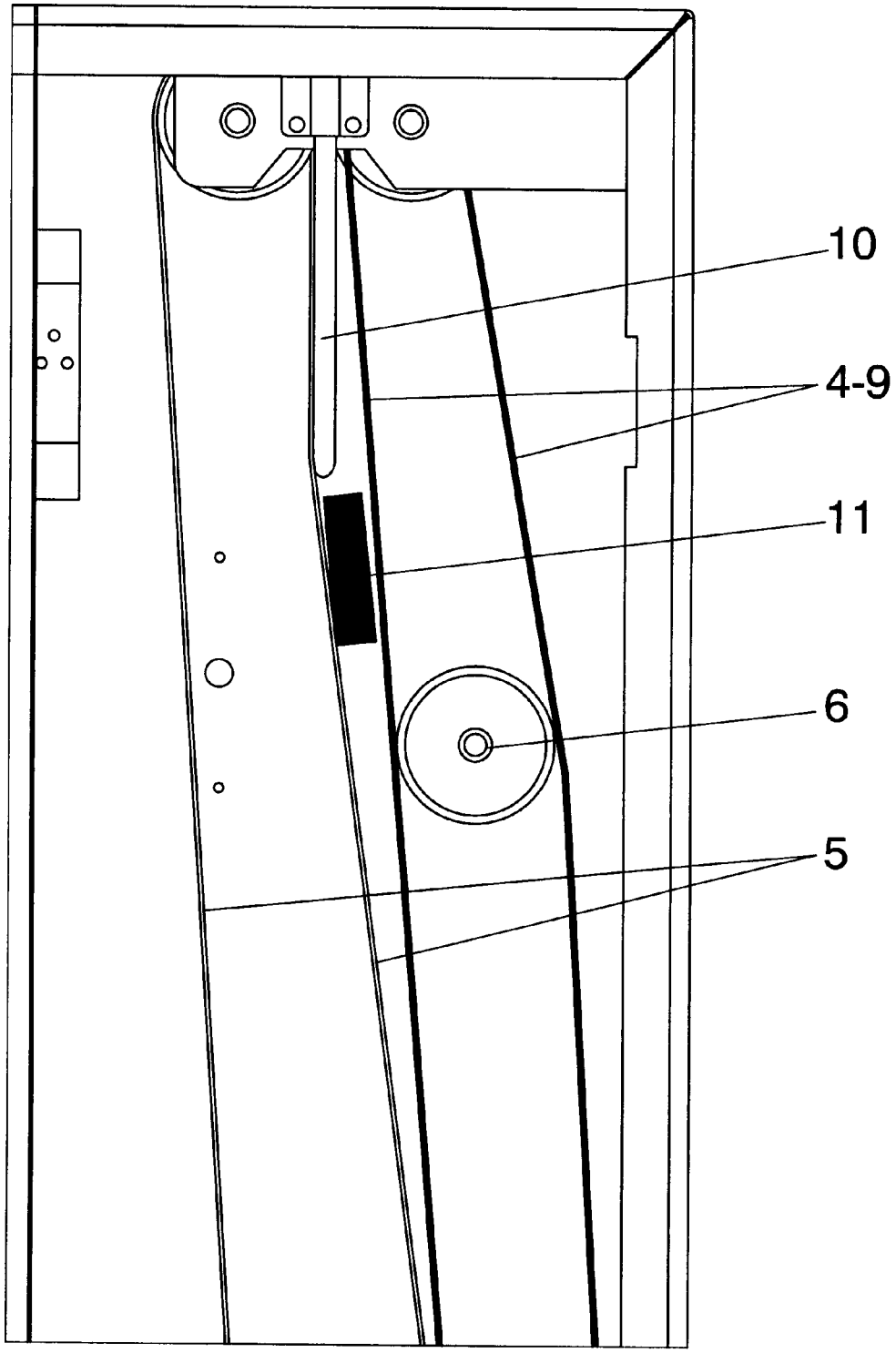
FIG. 4 shows a detail view of the diverter element positioned between the pair of elastic conveyor belts, which the product run up against.

Furthermore, there is also the possibility of having storage units 2 for the products, according to four grills at two heights, as can be seen in FIG. 2 of the drawings, in which case, as well as increasing the capacity, the range of products can also be expanded.

The collection compartment 3 for the product 11 is positioned on one side of the machine 1, as can be seen in FIG. 1 of the designs, being arranged in a vertical direction at the desired height, given that the manner of conveyance means that the products will always be conveyed in a vertical direction and in that position they are led to the collection compartment 3.

Moreover, the general aesthetic of the machine is improved by permitting virtually the entire front of the machine to be clear for the location of the desired ornamentation.

The second elastic conveyor belt 5, backed onto the side vertical section 9 of the first elastic conveyor belt 4, presents in its lower part a small horizontal section backed onto the horizontal section of the first elastic conveyor belt, facilitating the trapping of the product between both elastic conveyor belts.

The elasticity of the conveyor belts 4 and 5 permits them to be properly guided and, moreover, it permits the product to become trapped between them in a static position until diverted by the diverter element 10 towards the duct that leads to the collection compartment positioned at the desired height and place.

The automatic vending machines 1 for products presents a coin refund compartment 13 in a side position, independent of the compartment 3 for the collection of the product.

What is claimed is:

1. A system for conveying a selected product to a collection compartment in automatic vending machines, in which a unit of the selected product is extracted from a plurality of storage compartments, the system having:

a first elastic conveyor belt comprising a first horizontal section under the plurality of storage compartments and a second section in a vertical position on a side of the machine;

a second elastic conveyor belt being fitted in a position backing onto the vertical section of the first elastic conveyor belt;

a plurality of cylindrical bodies for guiding the first and the second elastic conveyor belts;

wherein:

one of the cylindrical bodies acts on the first elastic conveyor belt and one of the cylindrical bodies acts on the second elastic conveyor belt as drive elements for transmitting independent movement to the belts;

a plurality of freely rotating rods aid the cylindrical bodies in guiding the first and the second elastic conveyor belts;

a lower fixed plate is arranged close to the first horizontal section of the first elastic conveyor belt for defining a free section in said first elastic conveyor belt;

the second elastic conveyor belt further comprises a small lower horizontal section backed onto the free section of the first elastic conveyor belt;

when a selected product reaches the free section of the first elastic conveyor belt, said first elastic conveyor belt yields and the product is collected between the first elastic conveyor belt and the second elastic conveyor belt; and a diverter element is arranged on an upper part of the vending machine, in an inclined position, between the vertical section of the first elastic conveyor belt; and the second elastic conveyor belt for diverting the selected product towards a duct leadings to the collection compartment.

2. A system according to claim 1, wherein the product selected and dispensed by a corresponding unitary extractor falls onto the horizontal section of the first elastic conveyor belt, the product being conveyed by the first elastic conveyor belt until the vertical section, in relation to which the product is conveyed and raised by becoming trapped between the two backing faces of both elastic conveyor belts until the product runs up against the diverter element.

3. A system according to claim 1, wherein the collection compartment for the product is positioned on a side of the automatic vending machine and arranged in a vertical direction at a desired height.

4. A system according to claim 2, wherein the collection compartment for the product is positioned on a side of the automatic machine and arranged in a vertical direction at a desired height.

* * * * *